US010448719B2

(12) United States Patent
Coury

(10) Patent No.: US 10,448,719 B2
(45) Date of Patent: Oct. 22, 2019

(54) TRAVEL DEVICE

(71) Applicant: Dustin Coury, Los Angeles, CA (US)

(72) Inventor: Dustin Coury, Los Angeles, CA (US)

( * ) Notice: Subject to any disclaimer, the term of this patent is extended or adjusted under 35 U.S.C. 154(b) by 373 days.

(21) Appl. No.: 15/394,655

(22) Filed: Dec. 29, 2016

(65) Prior Publication Data

US 2018/0184776 A1 Jul. 5, 2018

(51) Int. Cl.

| | |
|---|---|
| ***A45C 13/03*** | (2006.01) |
| ***A47G 9/10*** | (2006.01) |
| ***A45C 13/10*** | (2006.01) |
| ***A45C 13/00*** | (2006.01) |
| ***B65B 5/00*** | (2006.01) |
| ***B65B 7/02*** | (2006.01) |
| ***A45F 4/08*** | (2006.01) |
| *A45C 13/02* | (2006.01) |

(52) U.S. Cl.

CPC ..... *A45C 13/03* (2013.01); *A45C 13/008* (2013.01); *A45C 13/103* (2013.01); *A45F 4/08* (2013.01); *A47G 9/10* (2013.01); *A47G 9/1045* (2013.01); *A45C 2013/026* (2013.01)

(58) Field of Classification Search

CPC ..... A45C 13/026; A45C 13/03; A45C 13/008; B65B 7/02; B65B 5/00; A47G 9/10; A47G 9/1045

USPC ..... 53/469; 493/935

See application file for complete search history.

(56) References Cited

U.S. PATENT DOCUMENTS

| | | | | |
|---|---|---|---|---|
| 5,427,453 | A * | 6/1995 | Cloessner | A45C 3/00 190/109 |
| 7,089,617 | B1 * | 8/2006 | Lauro | A47G 9/0253 5/490 |
| 2003/0052035 | A1 * | 3/2003 | Dickinson | B65D 5/4233 206/522 |
| 2015/0157148 | A1 * | 6/2015 | Collins | A47G 9/1045 5/639 |

OTHER PUBLICATIONS www.outdoorgearlab., Dec. 26, 2016, http://www.outdoorgearlab.com/Camping-Pillow-Reviews (11 pages).

* cited by examiner

*Primary Examiner* — Robert F Long
*Assistant Examiner* — Xavier A Madison
(74) *Attorney, Agent, or Firm* — Todd R. Miller

(57) ABSTRACT

A novel travel device and method of storing items are disclosed. The travel device may comprise a top shell joined to a bottom shell to form a container. A sleeve may be removably attached to the top and bottom shells but is preferably fixed to the interior of the container. The sleeve acts a second container for holding items such as dirty clothes. Clean clothes may be placed in the remaining portion of the interior of the first container thereby keeping the dirty clothes separate from the clean ones. The top shell, bottom shell, and sleeve are preferably made of fabric. The sleeve may be made of impermeable material and may include a sealable hole to store wet or particularly odorous items. The travel device advantageously is capable of storing both clean and dirty clothes at the same time while also functioning as a comfortable pillow.

8 Claims, 4 Drawing Sheets

TRAVEL DEVICE

BACKGROUND

The present disclosure relates generally to a storage container and particularly one that may double as a pillow when traveling, camping, or the like.

SUMMARY

One exemplary embodiment of the disclosed subject matter is a travel device comprising a top shell, a bottom shell, and a sleeve attached to the top and bottom shells. The top shell has a first side, an opposing second side, a first end, and an opposing second end. The bottom shell has a first side, an opposing second side, a first end, and an opposing second end. The first side of the top shell is preferably fixed to the first side of the bottom shell. The second side of the top shell is preferably fixed to the second side of the bottom shell. The first end of the top shell is preferably removably attached to the first end of the bottom shell. The second end of the top shell is preferably removably attached to the second end of the bottom shell. The top shell and bottom shell form an interior when fixed and removably attached to one another. The sleeve is preferably fixed to the top shell and the bottom shell in the interior.

The sleeve is preferably fixed to the top shell and bottom shell approximately midway between the first end and opposing second end of each. The first end of the top shell is preferably removably attached to the first end of the bottom shell via a zipper. The sleeve has a first end and an opposing second end, with the first end having a sleeve hole. The sleeve hole may include a zipper to close the sleeve hole. The sleeve may be comprised of impermeable material.

Another exemplary embodiment of the disclosed subject matter is a travel device comprising a top shell having a first side, an opposing second side, a first end, and an opposing second end. The device further comprises a bottom shell having a first side, an opposing second side, a first end, and an opposing second end. The first side of the top shell is attached to the first side of the bottom shell. The second side of the top shell is attached to the second side of the bottom shell. The first end of the top shell is attached to the first end of the bottom shell. The second end of the top shell is attached to the second end of the bottom shell, whereby the top and bottom shells create an interior when attached. The travel device further comprises a sleeve having a top fold and an opposing bottom fold. The top fold has a first side, an opposing second side, a first end, and an opposing second end. The bottom fold has a first side, an opposing second side, a first end, and an opposing second end. The first side of the top fold is fixed to the first side of the bottom fold. The second side of the top fold is fixed to the second side of the bottom fold. The first end of the top fold is fixed to the first end of the bottom fold. The second end of the top fold is attached to the top shell. The second end of the bottom fold is attached to the bottom shell. The second end of the top fold is preferably fixed to the top shell. The second end of the bottom fold is also preferably fixed to the bottom shell. The sleeve has a sleeve hole that may include a zipper to open and close the sleeve hole.

Another exemplary embodiment of the disclosed subject matter is a method of storing clean and dirty clothes at the same time while keeping them separate. The method may comprise creating a container comprised of a top shell and a bottom shell forming an interior; inserting a sleeve in the interior, wherein the sleeve has a hole at one end; attaching the sleeve to the top shell and bottom shell; placing dirty clothes through the hole in the sleeve to be contained in the sleeve; and placing clean clothes in the interior of the container outside of the sleeve. The container preferably has an opening at one end. The placing dirty clothes step includes placing the dirty clothes through the opening in the container. The sleeve preferably includes a zipper, further comprising closing the hole in the sleeve with the zipper after the placing dirty clothes in the container.

BRIEF DESCRIPTION OF THE DRAWINGS

Some non-limiting exemplary embodiments of the disclosed subject matter are illustrated in the following drawings. Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described. Dimensions of components and features shown in the figures are chosen for convenience or clarity of presentation. For convenience or clarity, some elements or structures are not shown or shown only partially and/or with different perspective or from different point of views.

DETAILED DESCRIPTION

For many, traveling is fun. For others, traveling is a chore. Whatever the situation, travel typically requires clean clothes that inevitably end up dirty. And thus begins the quandary of whether to pay for hotel laundry service, look for and find a bag to store the dirty clothes, or just stuff the dirty clothes next to the clean ones in the luggage.

For hikers or campers, the usual solution to the dirty clothes problem involves putting dirty clothes at the bottom of the backpack, followed by clean clothes or other items needed within easy reach. Those other items may include food, a tent, and a sleeping bag. If one is feeling the need for luxury without concern about extra weight, a sleeping mat and a pillow may also be hauled. For the hiker worried about weight but desiring the mat and the pillow, these items are typically inflatable. Each such item just sits there waiting to be taken out of the backpack, inflated, used, and then deflated. However, for hikers concerned about every ounce, a pillow usually consists of a jacket balled up and placed on the ground or inserted into a pocket of a sleeping bag designed to hold the balled-up jacket.

Accordingly, a travel device that stores both clean and dirty clothes at the same time while also functioning as a lightweight, comfortable pillow is desired.

A general non-limiting overview of practicing the present disclosure is presented below. The overview outlines exemplary practice of embodiments of the present disclosure, providing a constructive basis for variant and/or alternative and/or divergent embodiments, some of which are subsequently described.

Figure 1:
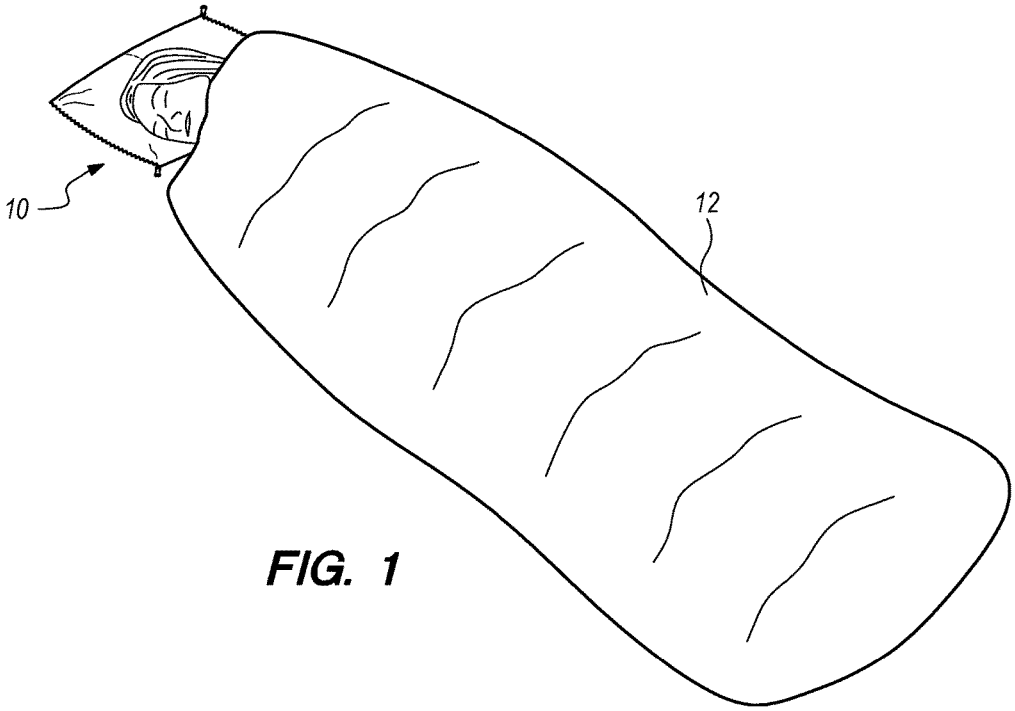
FIG. 1 is a perspective view of an embodiment of the travel device disclosed herein in an exemplary use situation.

FIG. 1 illustrates a perspective view of an embodiment of the travel device 10 in an exemplary use situation. As seen in FIG. 1, such a use situation may include a camping or hiking trip where a sleeping bag 12 is typically a necessity and a pillow may be considered a luxury. However, with the travel device 10 in hand, a user now finds at the ready a lightweight container capable of holding both clean and dirty clothes in respective compartments while also doubling as lightweight, comfortable pillow.

FIGS. 2-6 illustrate the novel travel device 10 comprising a top shell 14, a bottom shell 16, and an interior sleeve 18. Top shell 14, bottom shell 16, and interior sleeve 18 may by made of microsuede, nylon, or the like. Depending on use, the fabric may vary. For example, where the travel device 10 is to be used primarily indoors, then the top and bottom shells 14, 16 may be made of microsuede or similar material. Where the travel device 10 is to be used primarily outdoors such as for hiking, then the top and bottom shells 14, 16 may be made from a waterproof material. Whether for use indoors or outdoors, the interior sleeve 18 is preferably made from an impermeable material or the like capable of containing wet or odorous items.

The travel device 10 may be made by sewing or otherwise fixably attaching a first side 40 of a top shell 14 to a first side 48 of a bottom shell 16. Similarly, a second side 42 of the top shell 14 may be fixed to a second side 50 of bottom 16. The opposing ends 44, 46, 52, 54 of the top and bottom shells 14, 16, respectively, are removably attached to one another to create an opening as needed or to close off of the interior of the device 10. Such an opening may be seen as opening 32 in FIG. 3. The top and bottom shells 14, 16 may be removably attached to one another by way of zippers such as zippers 26, 28 seen in FIG. 3. Zipper 26 typically comprises a first component 26*a* adapted to engage with a second zipper component 26*b*. Similarly, zipper 28 may be comprised of first zipper component 28*a* and mating second zipper component 28*b*. In the alternative, only one end of the top and bottom shells 14, 16 may be removably attached, i.e., the other opposing end may be fixed.

Figure 2:
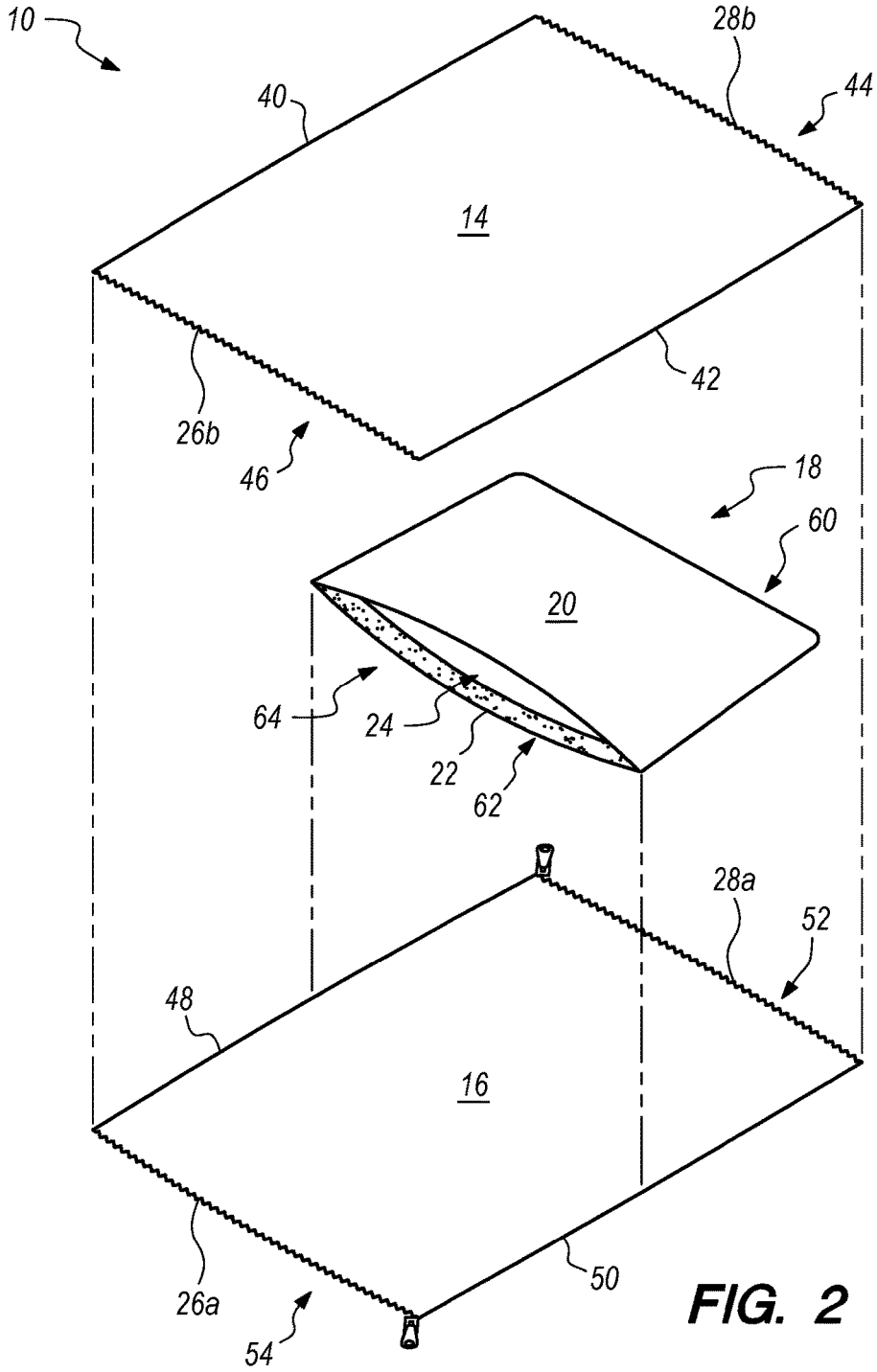
FIG. 2 is an exploded view of certain aspects of the travel device illustrating the device's top shell, bottom shell, and interior sleeve.
Figure 3:
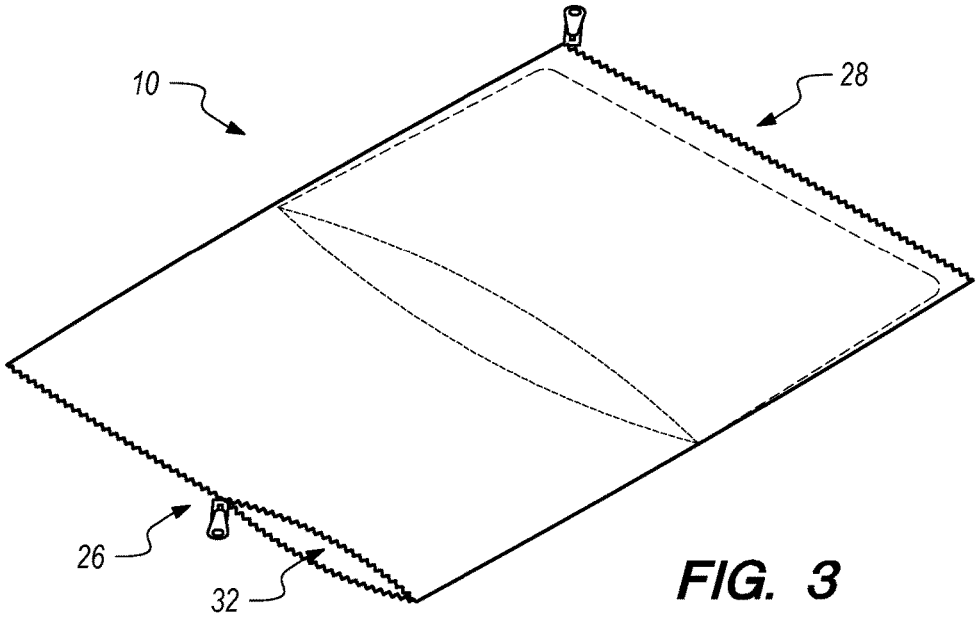
FIG. 3 is a perspective view of the device seen in FIG. 2 showing the interior sleeve of the device in dashed lines.

Sleeve 18 comprises a top fold 20 and an opposing bottom fold 22. The top fold 20 has a first side, an opposing second side, a first end, and an opposing second end. The bottom fold has a first side, an opposing second side, a first end, and an opposing second end. The first side of the top fold 20 is preferably fixed to the first side of the bottom fold 22. The first end of the top fold 20 is preferably fixed to the first end of the bottom fold 22. The opposing second end of the top fold 20 is preferably not fixed to the opposing second end of the bottom fold to create an opening 24 as seen in FIG. 2. Where the sleeve 18 is to used to contain wet or particularly odorous items, opening 24 may be sealed or otherwise closed such as via a zipper, hook and loop arrangement 64, or the like.

Figure 4:
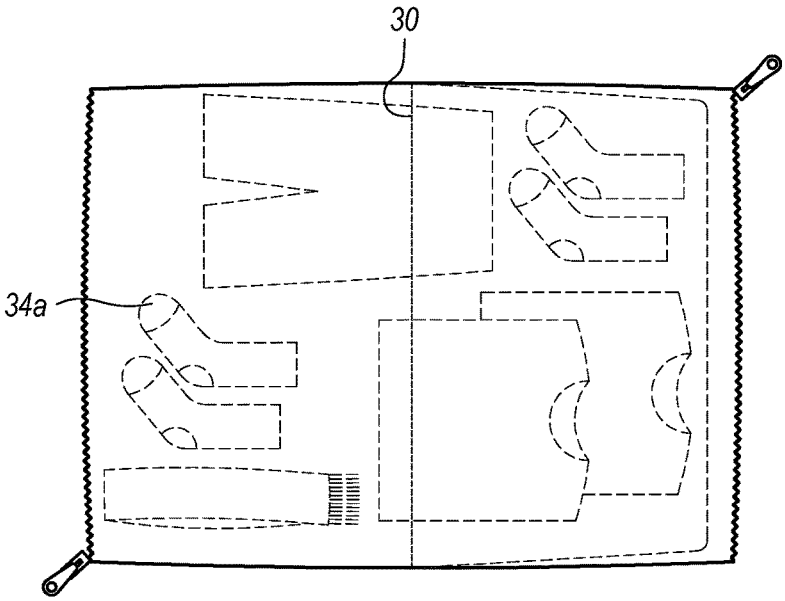
FIG. 4 is a top view of the travel device shown full with clean clothes only, wherein the interior sleeve and clothes are in dashed lines.

The sleeve 18 is preferably attached to top and bottom shells 14, 16 midway between their opposing ends and most preferably in the interior of the device 10 formed by attaching the top shell 14 to the bottom shell 16. The top fold 20 is preferably attached to the top shell 14. The bottom fold 22 is preferably attached to the bottom shell 16. The attachment is at the end 62 of the sleeve 18 that has sleeve hole 24 capable of being opened. Sleeve end 62 is opposite sleeve end 60. This attachment may be fixed such as by sewing the top shell 14 to the top fold 20 and sewing the bottom fold 22 to the bottom shell 16. FIG. 4 shows such an arrangement with stitching 30. In the alternative to being fixed, sleeve 18 may be removably attached to the top and bottom shells 14, 16 such as by a hook and loop arrangement or the like. The sleeve 18 is preferably half the size of the top and bottom shells 14, 16. When attached at the midpoint between the opposing ends of the shells 14, 16, this size allows sleeve 18 to move from one end to the other while also creating storage space roughly equivalent to half the volume of the device 10. In an arrangement where only one end of the device is capable of being opened, such as via zipper 26 that may create opening 32, then the hole 24 of sleeve 18 should face the opening 32 created by zipper 26.

FIG. 4 is a top view of the travel device 10 shown full with clean clothes 34*a* only, wherein the interior sleeve 18 and clothes 34*a* are in dashed lines. As can be seen in FIG. 4, clean clothes 34*a* are also contained in the interior of sleeve 18.

Figure 5:
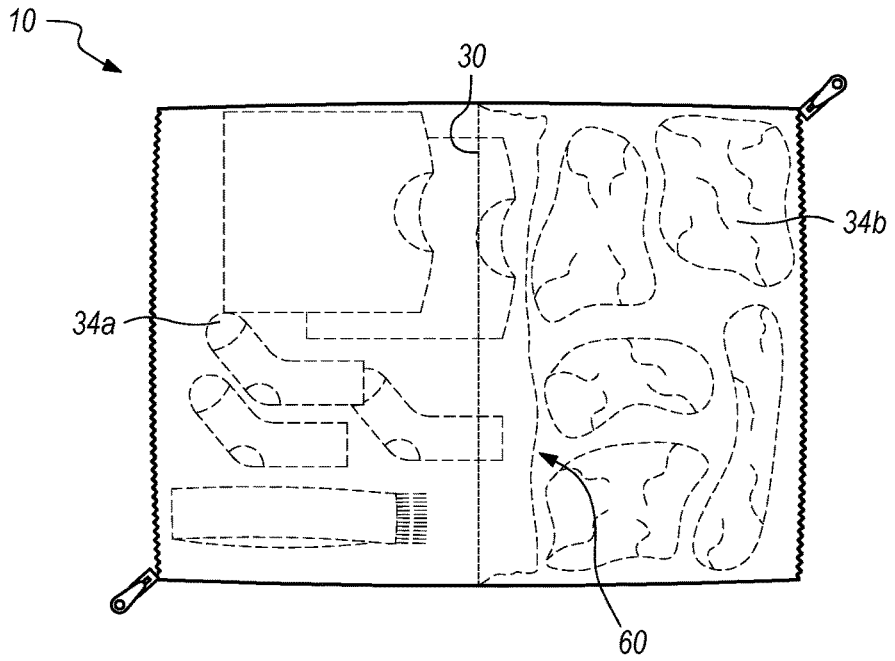
FIG. 5 is a top view of the travel device shown full with clean and dirty clothes, wherein the interior sleeve and clothes are in dashed lines.

FIG. 5 is a top view of the travel device 10 shown full with clean clothes 34*a* and dirty clothes 34*b*, wherein the interior sleeve 18 and clothes 34*a* and 34*b* are in dashed lines. As can be seen in FIG. 5, the dirty clothes 34*b* are contained in the interior of sleeve 18 and thus separated from clean clothes 34*a*.

Figure 6:
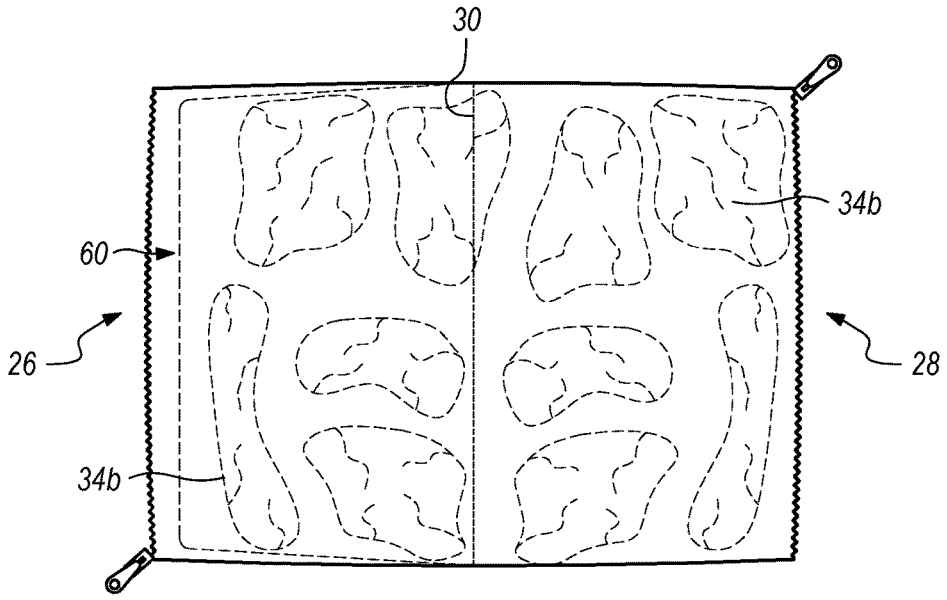
FIG. 6 is a top view of the travel device shown full with dirty clothes only, wherein the interior sleeve and clothes are in dashed lines.

FIG. 6 is a top view of the travel device 10 shown full with dirty clothes 34*b* only, wherein the interior sleeve 18 and clothes 34*b* are in dashed lines. As can be seen in FIG. 6, dirty clothes 34*b* are also contained in the interior of sleeve 18.

At the start of a vacation, hiking trip, or the like, a user may operate the travel device 10 as follows. Zipper 26 is unzipped to reveal an opening such as opening 32 seen in FIG. 3. In addition or in the alternative, the zipper 28 at the opposite end may also be opened. Clean clothes 34*a* may be placed inside of the device 10 in sleeve 18, as well as outside the sleeve 18, in amount sufficient to render a full, comfortable pillow such as that seen in FIG. 4. Zipper 26 is then zipped back up to close the opening 32. Any clean clothes 34*a* that become dirty may be placed into sleeve 18 by unzipping zipper 28 to create an opening (not shown), inserting dirty clothes 34*b*, and then zipping zipper 28 back up as illustrated in FIG. 5. When only dirty clothes 34*b* remain such that the amount of dirty clothes 34*b* exceeds the storage capacity of sleeve 18, then the dirty clothes 34*b* may be placed outside of sleeve 18 in the interior of device 10 as illustrated in FIG. 6. Advantageously, as seen in FIG. 5, the user has separated any dirty clothes from clean one while also creating a working pillow.

While certain embodiments have been described, the embodiments have been presented by way of example only and are not intended to limit the scope of the inventions. Indeed, the novel table leg connection described herein may be embodied in a variety of other forms. Furthermore, various omissions, substitutions, and changes in the form of the disclosed elements may be made without departing from the spirit of the inventions. The accompanying claims and their equivalents are intended to cover such forms or modifications as would fall within the scope and spirit of the inventions.

The invention claimed is:

1. A travel device comprising:

a rectangular top shell having a first side, an opposing second side, a first end, and an opposing second end;

a rectangular bottom shell having a first side, an opposing second side, a first end, and an opposing second end, wherein the first side of the top shell is fixed to the first side of the bottom shell;

wherein the second side of the top shell is fixed to the second side of the bottom shell;

wherein the first end of the top shell is removably attached to the first end of the bottom shell;

wherein the second end of the top shell is removably attached to the second end of the bottom shell;

and a tubular sleeve disposed between the top shell and the bottom shell wherein the sleeve has a first end and an opposing second end, wherein the second end of the sleeve has an opening for receiving items inside the sleeve, wherein the sleeve is attached to the top shell and the bottom shell approximately midway between the first end and opposing second end of each shell, and wherein the sleeve is attached only at the second end of the sleeve.

2. The travel device of claim 1, wherein the first end of the top shell is removably attached to the first end of the bottom shell via a zipper.

3. The travel device of claim 1, wherein the sleeve includes a hook and loop arrangement for closing the sleeve opening.

4. The travel device of claim 3, wherein the sleeve is comprised of impermeable material.

5. A method of storing clean and dirty clothes at the same time while keeping them separate, the method comprising:

using a container comprised of a top shell and a bottom shell forming an interior, wherein the top shell has opposing ends, and wherein the bottom shell has opposing ends;

inserting a sleeve in the interior, wherein the sleeve has a hole at one end;

attaching the sleeve to the top shell and the bottom shell, wherein the end of the sleeve having the hole is sewn onto the top shell and the bottom shell approximately midway between the ends of the top shell and the bottom shell;

placing clean clothes in the container and in the sleeve; and moving the sleeve to permit dirty clothes to be separated from clean clothes.

6. The method of claim 5, wherein the container includes one or more zippers for opening or closing the container.

7. The method of claim 5, wherein the sleeve includes a hook and loop arrangement for closing the hole in the.

8. The method of claim 7, wherein the top and bottom shells are comprised of waterproof material.

* * * * *